US006428339B1

(12) United States Patent
Davidson et al.

(10) Patent No.: US 6,428,339 B1
(45) Date of Patent: Aug. 6, 2002

(54) LOCKABLE ELECTRICAL CORD CONNECTOR UNIT

(76) Inventors: Richard G. Davidson, 1690 El Camino Real, Atascadero, CA (US) 93442; James K Bentley, P.O. Box 2848, Paso Robles, CA (US) 93447; Michael S O'Keefe, P.O. Box 2992, Paso Robles, CA (US) 93447

( * ) Notice: Subject to any disclaimer, the term of this patent is extended or adjusted under 35 U.S.C. 154(b) by 0 days.

(21) Appl. No.: 09/730,973

(22) Filed: Dec. 6, 2000

(51) Int. Cl.[7] ..... H01R 4/50
(52) U.S. Cl. ..... 439/346; 439/266
(58) Field of Search ..... 439/346, 258, 439/261, 263, 265, 266, 269.1, 269.2, 270, 372, 373, 535, 539

(56) References Cited

U.S. PATENT DOCUMENTS 3,891,289 A * 6/1975 Hanke ..... 439/106
4,136,919 A * 1/1979 Howard et al. ..... 439/346
4,375,307 A * 3/1983 Rock ..... 439/107
4,627,681 A * 12/1986 Hong ..... 439/370
5,286,213 A * 2/1994 Altergott et al. ..... 439/139
5,336,103 A * 8/1994 Herboldsheimer ..... 439/346
5,893,772 A * 4/1999 Carmo et al. ..... 436/346
5,941,724 A * 8/1999 Reed ..... 439/346
6,039,591 A * 3/2000 Marsh et al. ..... 439/265
6,234,823 B1 * 5/2000 Fuess ..... 439/346

* cited by examiner

*Primary Examiner*—P. Austin Bradley
*Assistant Examiner*—Ross Gushi
(74) *Attorney, Agent, or Firm*—Charles C. Logan, II

(57) ABSTRACT

A lockable electrical cord connector unit having a cylindrical connector housing made of electrically non-conductive material. A locking control ring telescopes over the connector housing and it is mechanically connected to structure within the connector housing that allows male electrical connector members extending from the housing to be locked into a female electrical socket. In an alternative embodiment the connector housing may have female sockets that can lock onto a male electrical terminal by using the same locking control ring structure. A second alternative embodiment provides for the connector housing to be an adaptor having male electrical terminal prongs extending from one end and having a female electrical socket formed in its other end. The locking ring allows both ends to be locked to mating electrical terminals.

26 Claims, 6 Drawing Sheets

K-AXIS
L-AXIS
X-AXIS
100
102
103
104
105
106
107
108
110
112
114
116
117
120
122
124
125
126
128
129
131
132
134
135
136
138
139
141
142
143
144
145
155
157
158
160
161
162
163
165
166
167
168

LOCKABLE ELECTRICAL CORD CONNECTOR UNIT

BACKGROUND OF THE INVENTION

The invention relates to an electrical connector and more specifically to one that can be locked onto either a male electrical terminal or a female electrical terminal.

Extension cords have been used for many years to lengthen the cord of an electrical device so that it can be connected to a remote power supply or receptacle. One end of the extension cord has a female socket that is sized to engage with a plug located on the cord of the electrical device while the other end of the extension cord is formed with a plug which is adapted to engage with a socket located at the power supply.

Quite often, while the user is moving the electrical device or when the extension cord or the cord of the device becomes entangled or caught, the extension cord will become disconnected from the device or the power supply. When this occurs, the user is forced to discontinue operations and to reestablish the electrical connection, thereby adding additional time to complete the task. Another problem is that the extension cord partially disconnects from the receptacle and has hot electrical contacts exposed to the user and the environment. In this situation, a person may accidently touch the electrical contact and sustain injuries or the electrical contacts may short and cause a fire and/or damage to the device, power supply or user.

In order to prevent the extension cord from becoming disconnected from the electrical device, users have often resorted to means such as tying a knot in the cord of the device and the socket end of the extension cord to isolate the plug/socket connection from induced stress. This method, is time consuming, and can damage the insulation surrounding the conductor, and shortens the effective life of the cord.

To overcome the above disadvantages, extension cords have been designed with a variety of locking mechanisms to securely connect the extension cord to the device or power supply. One such extension cord is shown in U.S. Pat. No. 4,085,991. It utilizes structure allowing engagement of the apertures formed in the prongs of a male electrical plug. Once engaged, the two members cannot be pulled apart and there is structure for releasing that engagement. A similar method of locking a connector onto the male prong of a male electrical plug is illustrated in U.S. Pat. No. 5,352,132.

Other prior art patents of interest are the following. The Chesler U.S. Pat. No. 3,691,327 discloses a circuit-closing adaptor having a key-operated lock means that closes the electrical circuit when the key is in the lock and which opens the circuit when the key is removed from the lock.

The Sherman U.S. Pat. No. 4,167,658 is directed to an electrical lock having a housing carrying a pair of prongs to be mounted in a conventional wall socket. It has a key operated cam in the housing that makes and breaks one of the contacts and latching means carried by that contact that mechanically locks onto the plug prong. The Solomon U.S. Pat. No. 4,579,410 is directed to a security attachment for an electrical plug that is effective to prevent unauthorized use and to readily permit authorized use.

The Windsor Jr. U.S. Pat. No. 4,875,874 is directed to a rotatable electrical connector arrangement for the secure snag free interlocking of the socket female end member of an electrical power extension cord, to the plug or male end member of an electrical power implement, or to any related device having a male plug member fixed to its power cord.

The Torok U.S. Pat. No. 5,108,301 is directed to a locking electrical cord connector that securely attaches at both the male and female ends.

It is an object of the invention to provide a novel lockable electrical cord connector unit that can be installed on the end of the electrical cord of an electrical device.

It is also an object of the invention to provide a novel lockable electrical cord connector unit that will prevent accidental disconnection.

It is another object of the invention to provide a novel lockable electrical cord connector unit that will prevent downtime previously caused by the electrical connections pulling apart.

It is an additional object of the invention to provide a novel lockable electrical cord connector unit that will reduce the cost of labor caused by downtime delays.

It is a further object of the invention to provide a novel lockable electrical cord connector unit that is easy and fast to install.

It is also an object of the invention to provide a novel lockable electrical cord connector unit that is inexpensive to manufacture and market.

It is another object of the invention to provide a novel lockable electrical cord connector unit that is safer since it prevents partial disconnection and exposed contacts.

It is also an object of the invention to provide a novel lockable electrical cord connector unit that will prevent the possibility of an electrical short that could cause a fire.

SUMMARY OF THE INVENTION

The lockable electrical cord connector unit has been designed with a basic component, an elongated cylindrical connector housing having a front wall structured as a female electrical terminal or as a male electrical terminal. The rear wall of the connector housing can have either a bore hole for receiving the end of an extension cord or it can be structured as a male electrical terminal. A substantially semi-circular groove extends around the outside of the bottom half of the connector housing to opposing positions near its mid point. A cylindrical bore extends inwardly from the front wall of the connector housing and extends a substantial portion of the length of the connector housing and in some cases its entire length. A ground cylinder is telescopically received in the cylindrical bore. An eccentric control pin has its front end connected to the ground cylinder and its rear end is connected to a control pin guide that is attached to the inner surface of a locking control ring that telescopes over the connector housing. The locking control ring can be rotated through a range of approximately 180 degrees which would cause the ground cylinder to rotate at the same time. When the connector housing has the mating male and female wedge structure incorporated in its interior, a male electrical plug that has been inserted into the front end of the connector housing can be locked in its female socket by the rotation of the locking control ring in one direction and it may be released by rotation in the opposite direction. Where a male electrical structure is either extending from the front wall or the rear wall of the connector housing, the rotation of the locking control ring will cause the ground pin to be rotated in such a manner that it will lock into a ground receptacle into which it has been inserted.

Utilizing the basic connector housing structure and the locking control ring, one embodiment of the lockable electrical cord connector unit can have its rear end connected to an extension cord and its front end structured as a female receptacle for a male electrical terminal plug. Using the same basic connector housing and the locking control ring structure, a second embodiment can be assembled with an extension cord connected to its rear end and its front end can be structured with projecting male conductor blades and a ground pin. A third embodiment using the same basic connector housing structure and the locking control ring can be produced in the form of an adaptor having a female front end and a male rear end. The exact manner in which the different embodiments function is fully described later in the specification.

DESCRIPTION OF THE PREFERRED EMBODIMENT

Figure 1:
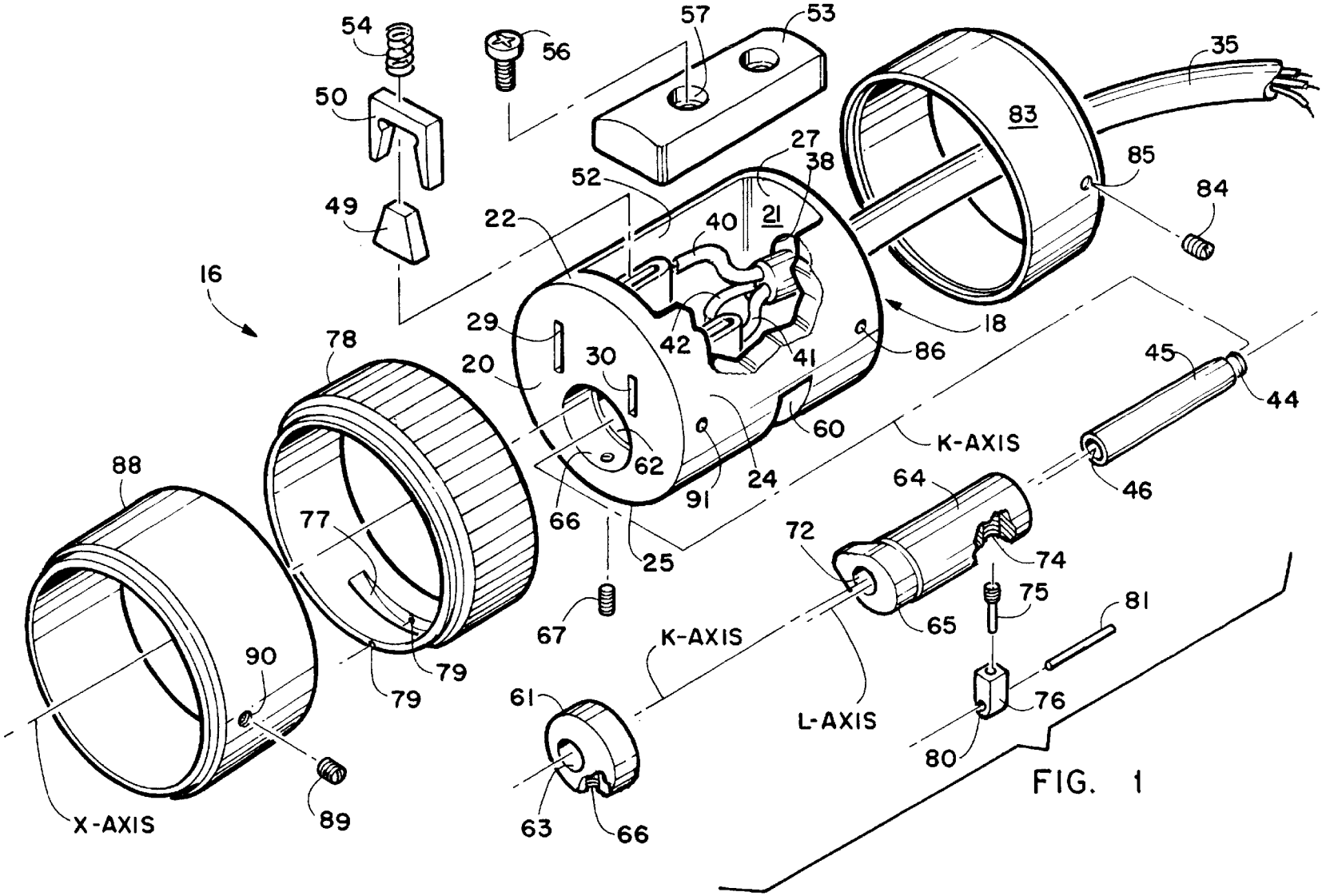
FIG. 1 is an exploded front perspective view of the novel lockable electrical cord connector unit showing an embodiment having a female receptacle in the front wall of the connector housing.
Figure 2:
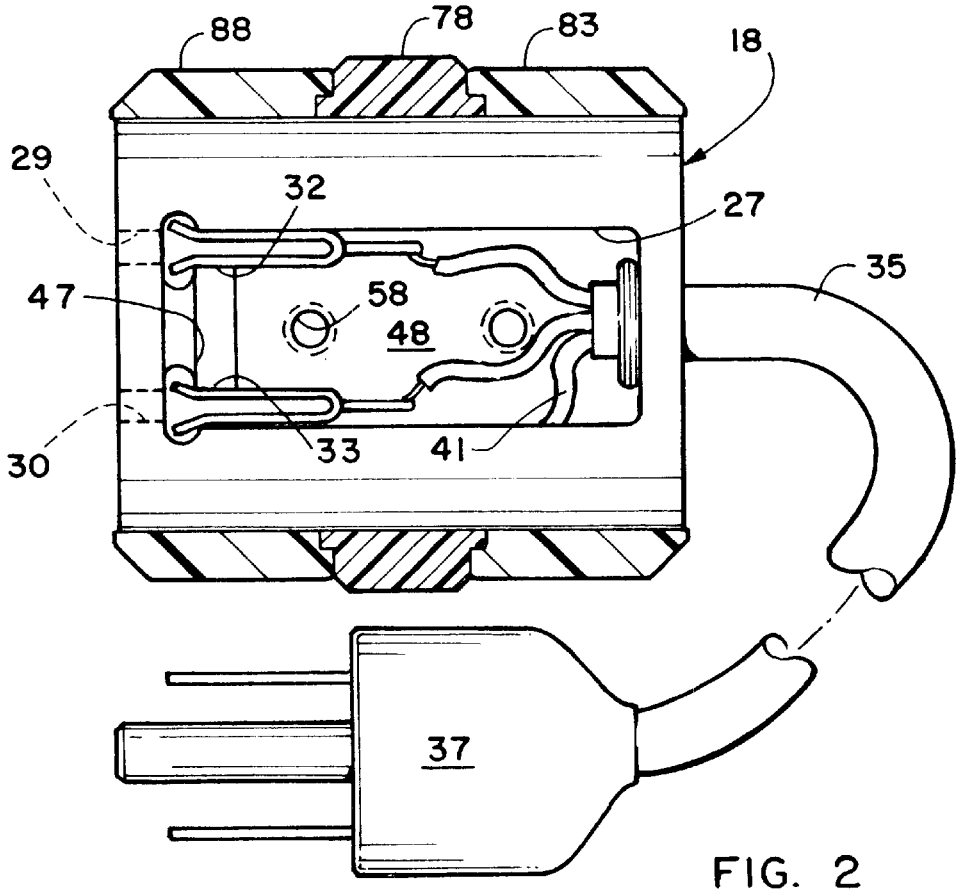
FIG. 2 is a horizontal cross sectional view taken through the connector housing and also showing an extension cord attached thereto.

The first embodiment of the lockable electrical cord connector unit will now be described by referring to FIGS. 1–3 of the drawings. The lockable electrical cord connector unit is generally designated numeral 16 and it has as its primary component connector housing 18 having a longitudinally extending X-axis.

Connector housing 18 has a front wall 20, a rear wall 21, a top side 22, a left side 23, a right side 24 and a bottom side 25. A cavity or chamber 27 is formed in the interior of connector housing 18. A pair of laterally spaced sockets 29 and 30 are formed in front wall 20 for removably receiving the male prongs of an electrical plug. A first pair of elongated electrical terminal members 32 and 33 are supported in cavity 27 with their respective front ends adjacent the rear ends of the respective sockets 29 and 30 so that they would be placed in electrical contact with the laterally spaced male prongs of an electrical connector when the male prongs are inserted into the respective sockets.

An extension cord 35 has a male electrical plug 37 connected on its rear end. The front end of extension cord 35 passes through an aperture 38 in rear wall 21. Electrical conductor wires 40 and 42 along with a ground wire 41 pass through the length of extension cord 35. Electrical conductor wires 40 and 42 are soldered or otherwise connected to the rear ends of electrical terminal members 32 and 33. Ground wire 41 is connected by a ground clip terminal 43 to an annular ground clip channel 44 on the rear end of cylinder ground tube 45. Ground tube 45 has a bore hole 46 having a L-axis.

Part of cavity 27 in connector housing 18 forms an open space 47 immediately forward of support platform 48 that is formed in the interior of connector housing 18. Male wedge 49 reciprocally telescopes up into and retracts from female wedge 50 and both captured in open space 47. An opening 52 is formed in top surface 22 for removably receiving wedge assembly retaining cover 53. When in its assembled position, wedge assembly retainer cover 53 presses downwardly upon spring 54 to keep a downward pressure on female wedge 50. As male wedge 49 is pushed upwardly, it causes the legs of female wedge 50 to be spread apart with a sufficient force that they press outwardly upon the respective electrical terminal members 32 and 33 and rigidly lock the male prongs of an electrical plug that has been inserted through the respective sockets 29 and 30. A pair of screws 56 pass through the respective apertures 57 in wedge assembly retainer cover 53 and are locked into the threaded bore holes 58 in support platform 48.

Figure 1A:
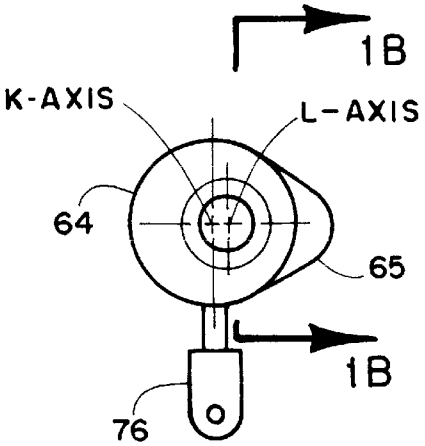
FIG. 1A is a rear elevation view of the ground tube inserted into the rear end of the ground cylinder.
Figure 1B:
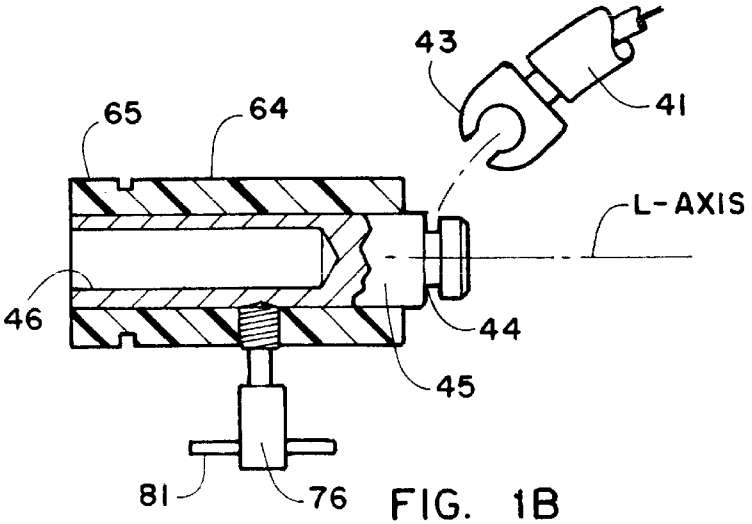
FIG. 1B is a vertical cross section taken along lines 1B—1B of FIG. 1A.

Connector housing 18 has an eccentric control pin slot 60 in its outer surface that has an arc of approximately 180 degrees. An eccentrically located bore hole 62 having a K-axis extends through front wall 20 and through at least most of the length of connector housing 18. Bore hole 62 communicates with the inner edge of slot 60. Ground cylinder 64 is telescopically received into bore hole 62 and cam member 65 that is formed on the front end thereof aligns with the bottom of open space 47 immediately beneath male wedge 49. Ground cylinder 64 has an eccentric L-axis that receives ground tube 45. This structure is best described by referring to FIGS. 1A and 1B. FIG. 1A is a rear elevation view of ground cylinder 64 that has a concentric K-axis and ground tube 45 that has an eccentric L-axis. The front end of bore hole 62 has an enlarged aperture 66 which allows cam member 65 to pass inwardly therethrough. Outer disk 61 has a bore hole 63 having a L-axis and a transversely extending threaded bore 66 for receiving threaded screw 67. Bore hole 63 aligns with a bore hole in ground cylinder 64 and bore hole 46 in ground tube 45 for receiving the ground pin of a male electrical plug.

Figure 3C:
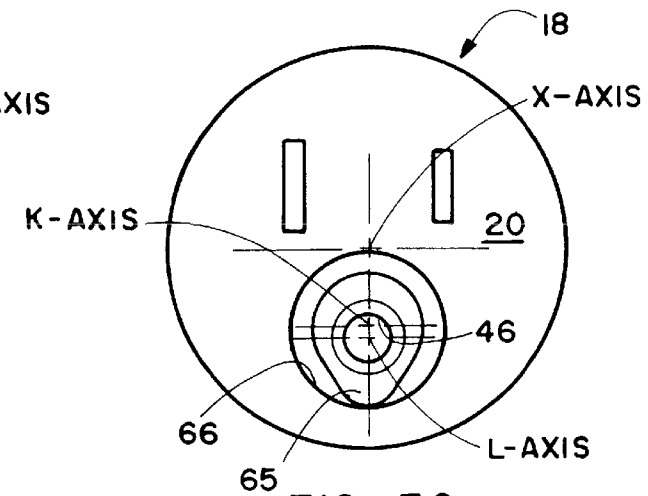
FIGS. 3A–3C are schematic front elevation views of the connector housing showing how the lobe of the cam member travels to raise and lower the male wedge as it travels from an unlocked position to a fully locked position.
Figure 3B:
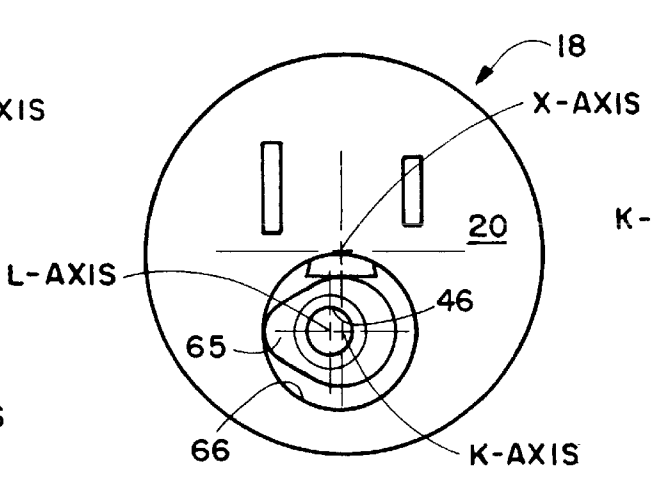
Figure 3A:
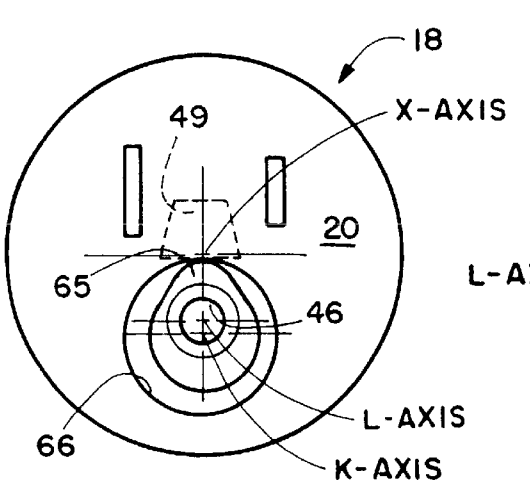
Figure 6:
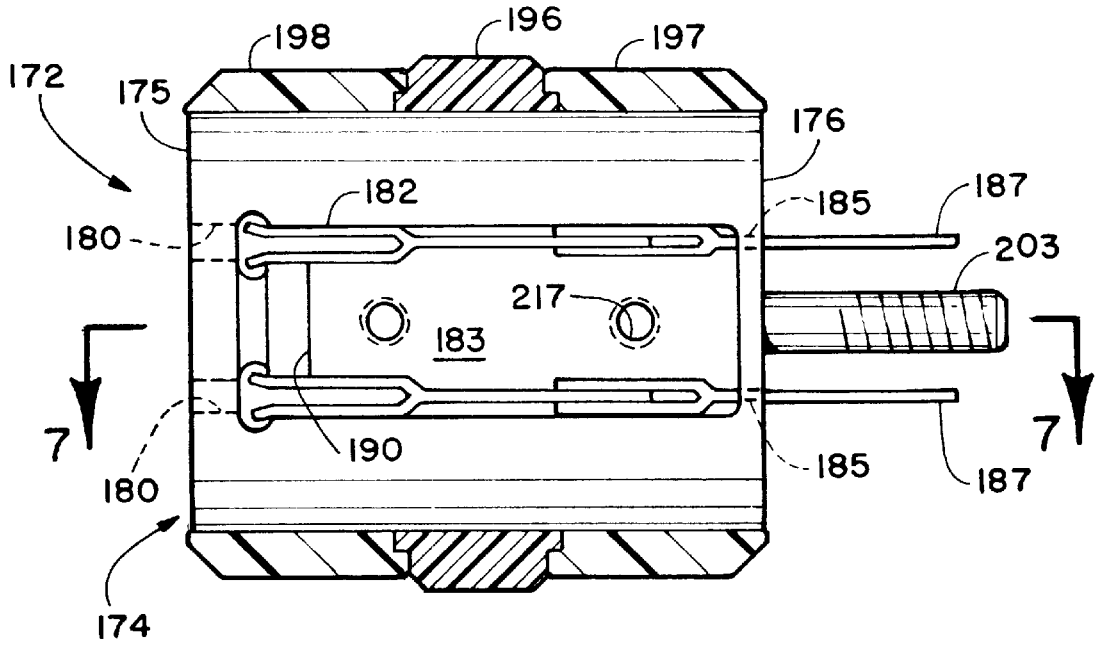
FIG. 6 is a horizontal cross sectional view through an adaptor embodiment of the lockable electrical cord connector unit.

A threaded bore hole 74 receives the top end of an eccentric control pin 75 whose bottom end is connected to control pin sleeve 76. Control pin 75 and control pin sleeve 76 are positioned in slot 60 so that they may travel through a range of approximately 180 degrees as ground cylinder 64 is rotated. Locking control ring 78 has an eccentric control pin guide recess 77 formed on its inner surface. A pair of longitudinally aligned bore holes 79 align with aperture 80 in control pin sleeve 76 for receiving pin 81. When locking control ring 78 is telescopically received on connector housing 18 at its proper position and connected to pin 81, a 180-degree rotation of locking control pin 75 will be possible due to the arcuate configuration of slot 60. This will cause eccentric ground cylinder 64 to rotate through the same number of degrees thereby causing male cam member 65 to push upwardly on male wedge 49 into the spreadable legs of female wedge 50. This will lock the male prongs of a male connector plug rigidly within connector housing 18. FIGS. 3A–3C illustrates the manner in which cam member 65 travels and ground tube bore hole 46 travels. A reverse rotation of locking control ring 78 will lower male wedge cam 65 and disengage female wedge 50 and male wedge 49 from locking engagement with the inner surface of electrical terminal members 32 and 33. The ground pin of a male connector plug that is inserted into bore hole 46 will also be rigidly locked to connector housing 18 when locking control ring 78 is rotated approximately 180 degrees. A rear cover ring 83 telescopes over the rear end of connector housing 18 and is secured in position by a set screw 84 that passes through the respective threaded aperture 85 and threaded bore 86. Front cover ring 88 telescopes over the front end of connector housing 18 and is secured in position by set screw 89 that passes through the respective threaded apertures 90 and 91.

Figures 4, 5:
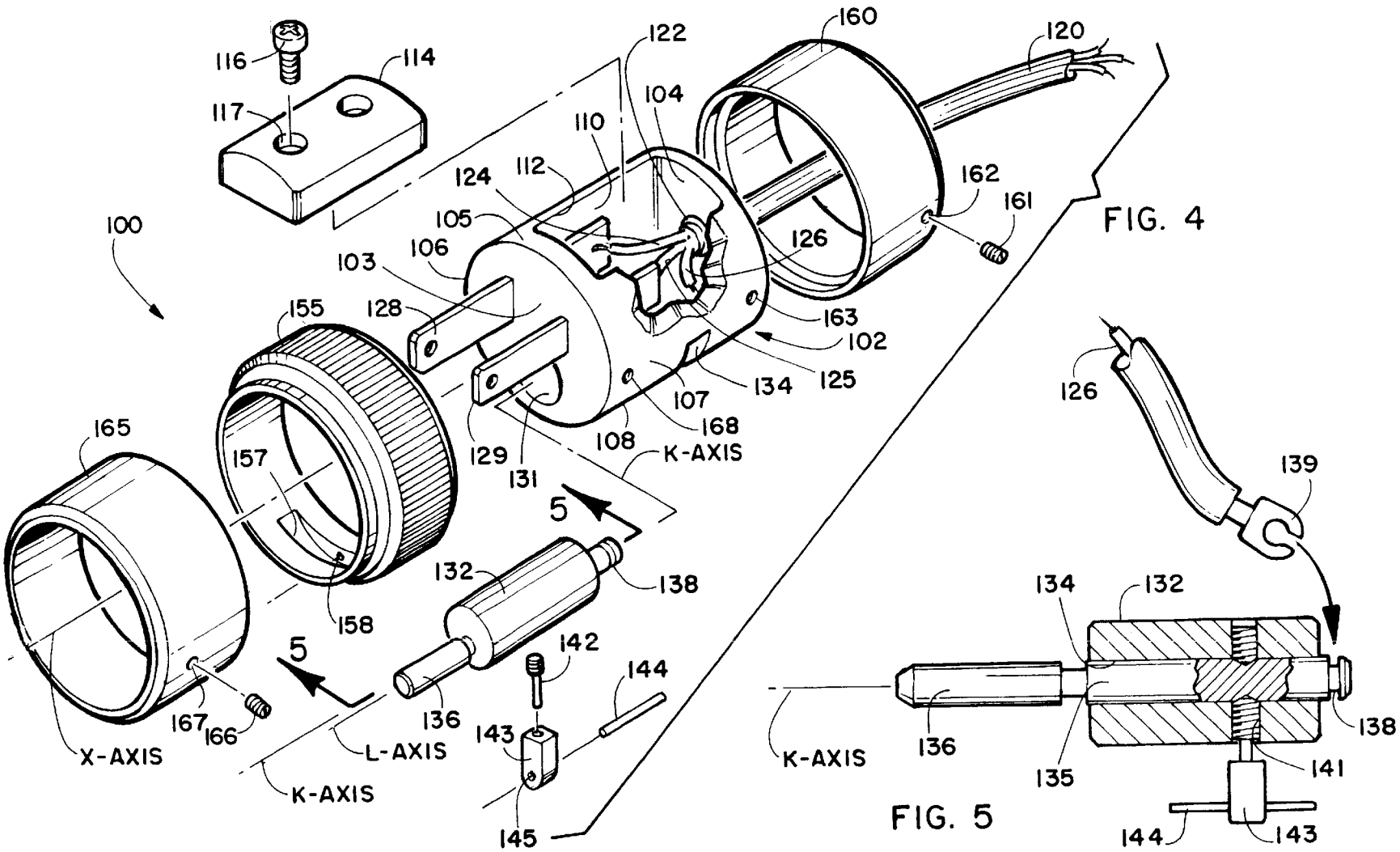
FIG. 4 is an exploded front perspective view of a first alternative embodiment of the lockable electrical cord connector unit having male electrical terminal members extending from the front wall of the connector housing.
FIG. 5 is a side elevation view of the eccentric locking ground pin and the ground pin cylinder with portions broken away for clarity.
Figure 5C:
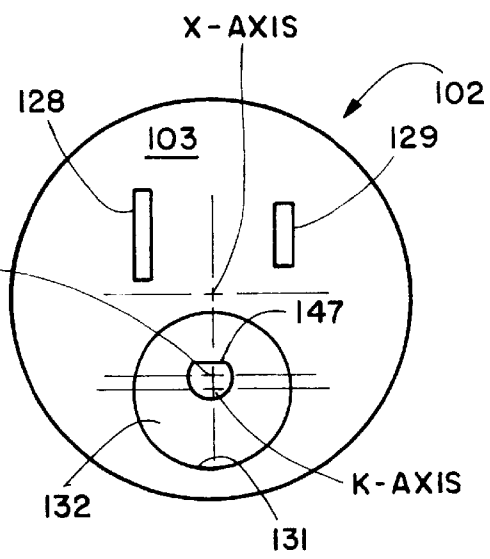
FIGS. 5A–5C schematically show the eccentric locking ground pin as it travels between its unlocked position and its locked position.

A first alternative embodiment of the lockable electrical cord connector unit is illustrated in FIGS. 4 and 5–5C and it is generally designated numeral 100. It has a cylindrical connector housing 102 made of electrical non-conductive material having a front end 103, a rear end 104, a top surface 105, a left side 106, a right side 107 and a bottom surface 108. A cavity 110 is formed in connector housing 102 and an aperture 112 is formed in top surface 105 for removably receiving a removable assembly cover 114. The interior of cavity 110 would have a support platform with a pair of longitudinally spaced threaded bore holes such as illustrated in FIG. 2. Screws 116 passing through threaded apertures 117 would secure the assembly cover to housing 102.

An extension cord 120 could have its rear end connected to a power tool, a male electrical plug or a female electrical plug. The front end of extension cord 120 passes through an aperture 122 in rear wall 104. Extension cord 120 has electrical conductor wires 124 and 125 and a ground wire 126. Front wall 103 has a pair of laterally spaced sockets through which pass electrical terminal members or blades 128 and 129. A bore hole 131 in front wall 103 having an eccentric K-axis extends inwardly at least most of the length of connector housing 102 for receiving eccentric ground pin cylinder 132. An arcuate slot 134 extends approximately 180 degrees around the bottom of connector housing 102 with its inner end in communication with bore hole 131.

Figure 5B:
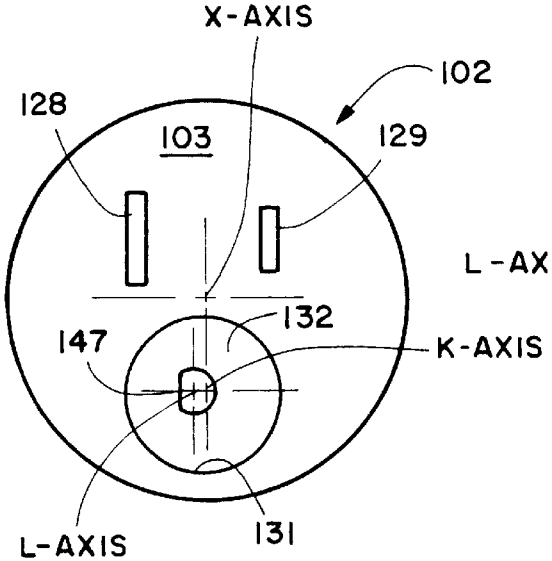
Figure 5A:
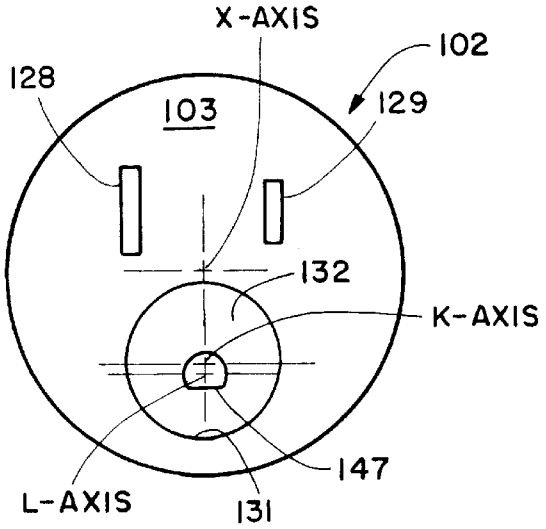

Eccentric ground pin cylinder 132 has a longitudinally extending bore 134 having a K-axis. An elongated conductor rod 135 has a locking ground pin 136 formed on its one end and it has an annular ground clip channel 138 formed on its other end. A rotating ground clip terminal 139 is connected to the end of ground wire 126 and it is detachably secured onto ground clip channel 138. A threaded bore hole 141 is formed in the bottom surface of ground pin cylinder 132 for receiving the eccentric control pin 142. The bottom end of control pin 142 is connected in the top end of control pin sleeve 143. A control sleeve set pin 144 passes through bore hole 145 of control pin sleeve 143. Eccentric locking ground pin 136 has a flat surface 147 along its one side. When eccentric locking ground pin 136 is inserted into a mating female electrical socket, flat surface 147 faces downwardly. When it is rotated approximately a half rotation, the eccentric locking ground pin rotates off center and locks itself in the socket thus preventing the disconnecting of the connector housing therefrom. FIGS. 5A–5C schematically show how the eccentric locking ground pin travels first from its completely unlocked position in FIG. 5A to its completely locked position in FIG. 5C.

A locking control ring 155 has a recessed control pin guide 157 formed on its inner surface for receiving the bottom end of control pin sleeve 143. Control sleeve set pin 144 passes through the longitudinally aligned bore holes 158 to lock control pin sleeve 143 therein. Rotation of locking control ring 155 through approximately 180 degrees causes control pin sleeve 143 to travel radially throughout that same angulation and cause ground pin cylinder 132 to rotate about its K-axis. In one extreme position of locking control ring 155, locking ground pin 136 will be free to enter or be removed from its appropriate female socket. At the other end of the rotation of locking control ring 155, locking ground pin 136 will be locked so tightly in the receptacle socket that connector housing 102 cannot be removed. A rear cover ring 160 has a set screw 161 that is threaded into aperture 162 and threaded bore hole 163. A front cover ring 165 has a set screw 166 that is threaded into a bore hole 167 and threaded bore hole 168.

A second alternative embodiment of the lockable electrical cord connector unit is illustrated in FIGS. 6–11. It is an adaptor connector unit that has a female receptacle structure on its front end and male connector structure on its rear end. These respective locking structures function exactly the same as the two previously discussed embodiments. The locking adaptor unit is generally designated numeral 172. It has a connector housing 174 having a front wall 175, a rear wall 176, a top surface 177 and a bottom surface 178. A pair of laterally spaced sockets 180 are formed in front wall 175. A first pair of electrical terminal members or blades 182 are mounted in the top surface of support platform 183. Their front ends are aligned with the sockets 180 to receive the prongs of a male electrical connector. Rear wall 176 has a laterally spaced pair of bore holes 185. A second pair of electrical terminal members or blades 187 have their front end connected to the rear end of the respective first pair of electrical terminal members 182. The rear ends of the second set of electrical terminal members 187 pass through the respective bore holes 185. A cavity 190 is formed in front of support platform 183 for receiving male wedge 192, female wedge 193 and the lobe of cam member 194. Connector housing 174 has an X-axis around which the locking control ring 196 rotates. Rear cover ring 197 and front cover ring 198 are rigidly secured to the outer surface of connector housing 174 in the same manner as described with the first two embodiments.

Figure 7:
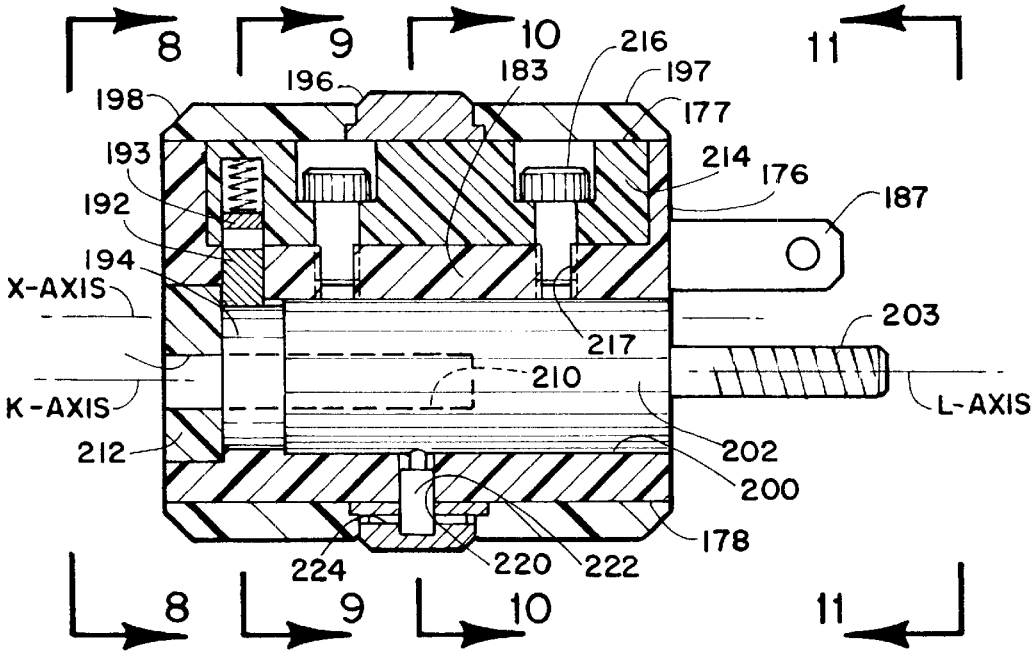
FIG. 7 is a vertical cross section view taken along lines 7—7 of FIG. 6.

As seen in FIG. 7, a bore hole 200 extends inwardly from rear wall 176 and it has a longitudinally extending K-axis. An eccentric ground cylinder 202 having an eccentric locking ground pin 203 extending from its rear end is received in bore hole 200. Ground pin 203 has an eccentric L-axis. The front end of ground cylinder 202 has a bore hole 210 for receiving the ground terminal of a male electrical plug. Spaced forwardly of ground cylinder 202 is cam member 194 having its aligned bore hole and a cap plug 212 also having an aligned bore hole through which the ground pin of a male electrical can pass.

Figure 8:
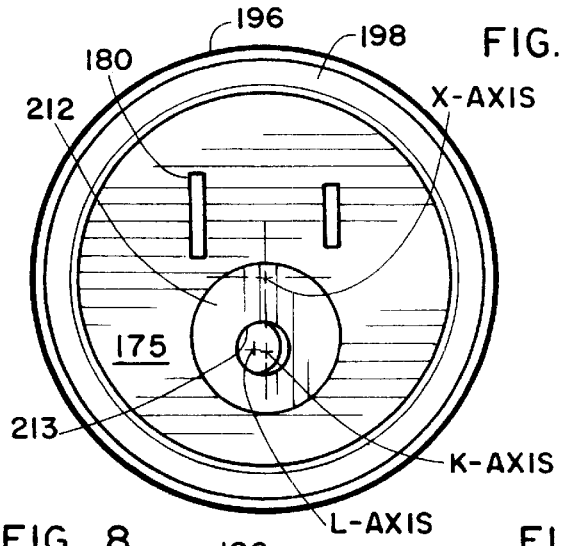
FIG. 8 is an end elevation view taken along lines 8—8 of FIG. 7.
Figure 9:
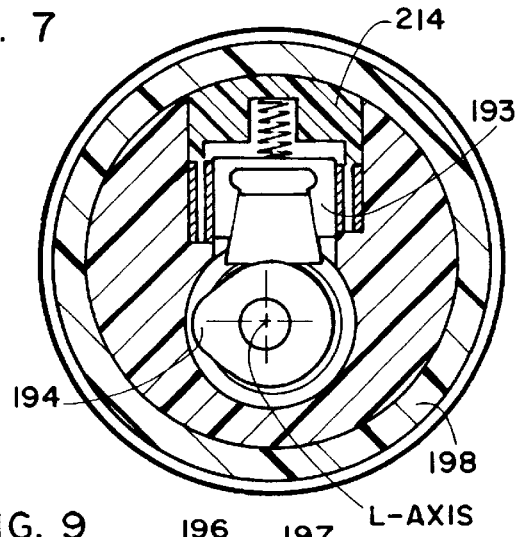
FIG. 9 is a cross sectional view taken along lines 9—9 of FIG. 7.
Figure 10:
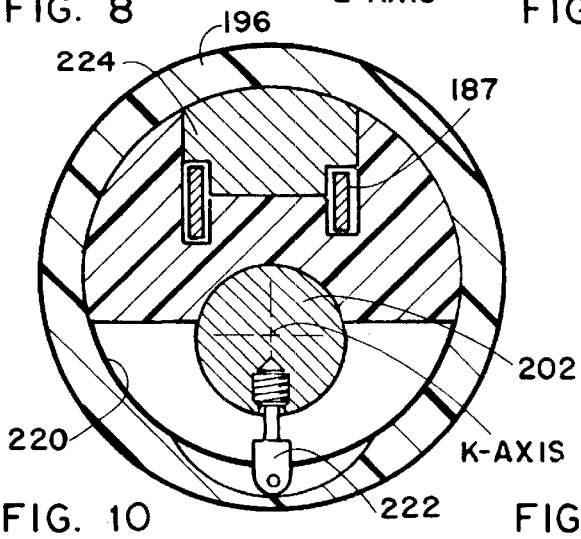
FIG. 10 is a cross sectional view taken along lines 10—10 of FIG. 7.
Figure 11:
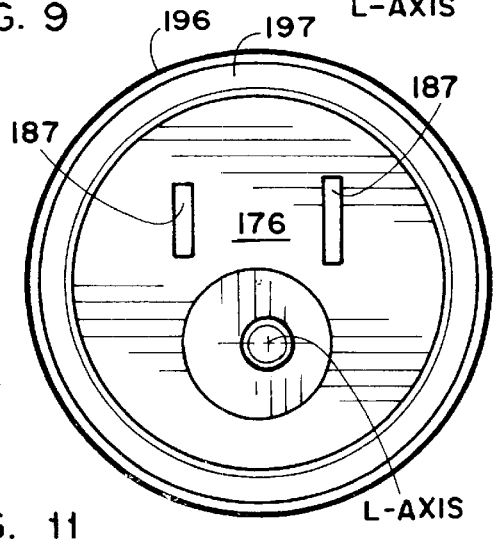
FIG. 11 is a rear end elevation view taken along lines 11—11 of FIG. 7, respective sockets.

A retainer cap 214 is received in an aperture in the top surface of connector housing 174 and it is secured in place by screws 216 that are threaded into bore holes 217 in the support platform 183. Connector housing 174 has a radial slot 220 that extends for about 180 degrees and through which passes eccentric control pin sleeve 222. Control pin sleeve 222 is connected by pin 224 to the control pin guide on the inner surface of locking control ring 196. The control pin extending upwardly from control pin sleeve 222 is screwed into the bottom surface of ground pin cylinder 202. Rotation of locking control ring 196 provides a locking action simultaneously to each end of the electrical cord connector unit 172. In one sequence, the rear end of the unit has the ground pin 203 rotated in the socket in which it is inserted. Because it is eccentric, it locks in its uppermost position to form a locked tight connection. With the same rotation of ground pin cylinder 202, cam member 194 drives male wedge 192 up into female wedge 193 causing its arms to spread tightly against the inner surface of the electrical terminal members or blades 182 which then grabs the male blades of a male connector sufficiently tight enough that they cannot be removed from the connector housing 174. FIG. 8 is a rear elevation view showing the eccentric L-axis of bore hole 213. FIG. 9 shows how cam member 194 forces male wedge 192 up into female wedge 193 to force the inner sides of electrical terminal members 182 outwardly and lockingly grip the prongs of a male electrical plug. FIG. 10 shows how locking ring 196 rotates eccentric ground cylinder 202. FIG. 11 is a rear elevation view showing eccentric locking ground pin 203.

What is claimed is:

1. A lockable electrical cord connector unit comprising:

a connector housing having a front wall, a rear wall, a top surface, a bottom surface, a left side and a right side; said connector housing being made of electrically non-conductive material; said connector housing having a longitudinally extending X-axis;

a cavity formed in said connector housing;

a first pair of laterally spaced sockets formed in said front wall of said connector housing for removably receiving the male prongs of an electrical plug; a first pair of elongated electrical terminal members each having a front end and a rear end; means for supporting said respective first pair of elongated electrical terminal members with their respective said front ends adjacent said respective sockets so they would be placed in electrical contact with the laterally spaced male prongs of an electrical connector when the male prongs are inserted into said first pair of sockets;

wedge means reciprocally mounted in said cavity so that said wedge means can travel back and forth between said first pair of elongated terminal members from a first position in which the male prongs of an electrical plug are free to travel in and out of said pair of laterally spaced sockets and a second position that locks the respective male prongs of an electrical connector against said respective first pair of electrical terminal members; and means for actuating movement of said wedge means between said first position and said second position comprising a locking control ring having a front end, a rear end and an inner surface; said locking control ring being telescopically mounted over said connector housing so that it may be rotated with respect to said connector housing between a locked position and an unlocked position.

2. A lockable electrical cord connector unit as recited in claim 1 further comprising an electrical extension cord having at least two electrical conductor wires each having a front end and a rear end; a male electrical plug is connected to said rear end of said electrical conductor wires; said front end of said electrical extension cord passing through an aperture in said rear wall of said connector housing and said two respective electrical conductor wires being connected to said respective rear ends of said first pair of elongated electrical terminal members.

3. A lockable electrical cord connector unit as recited in claim 2 wherein said electrical extension cord has a ground wire having a front end and a rear end; said front wall of said connector housing having an electrical ground terminal socket formed in said front wall of said connector housing; first electrical ground connector means located in said connector housing for electrically connecting said front end of said ground wire of said electrical extension cord to said electrical ground terminal socket.

4. A lockable electrical cord connector unit as recited in claim 1 wherein said inner surface of said locking ring has a recessed eccentric control pin guide.

5. A lockable electrical cord connector unit as recited in claim 4 wherein said means for actuating movement of said wedge means further comprises a cylindrical bore hole having a longitudinal K-axis extending inwardly from said front wall of said connector housing; an eccentric cam ground cylinder having a front end, a rear end and an outer surface is rotatably mounted in said cylindrical bore hole.

6. A lockable electrical cord connector unit as recited in claim 5 wherein said means for actuating movement of said wedge means further comprises a radially oriented control pin having an inner end and an outer end; said inner end being captured in said outer surface of said cam ground cylinder and said outer end having means fixedly connecting said outer end in said eccentric control pin guide in said inner surface of said locking ring; said outer surface of said connector housing having an arcuate control pin slot that communicates with said cylindrical bore hole and said eccentric control pin passes through said control pin slot during arcuate travel of said control pin.

7. A lockable electrical cord connector unit as recited in claim 1 wherein said wedge means comprises a male wedge member aligned to reciprocally enter and withdraw from a female wedge member in response to rotation of said locking ring around said connector housing.

8. A lockable electrical cord connector unit as recited in claim 1 wherein said top surface of said connector housing has a wedge retainer cover aperture formed therein that communicates with said cavity in which said wedge means is mounted; a wedge retainer cover is removably mounted in said wedge retainer cover aperture.

9. A lockable electrical cord connector unit as recited in claim 1 further comprising a front cover ring and a rear cover ring that are telescopically mounted over said connector housing respectively in front of and behind said locking control ring; and means for securing said front ring cover and said rear cover ring to said connector housing to prevent rotation with respect to said connector housing.

10. A lockable electrical cord connector unit comprising:

a connector housing having a front wall, a rear wall, a top surface, a bottom surface, a left side and a right side; said connector housing being made of electrically non-conductive material; said connector housing having a longitudinally extending X-axis;

a cavity formed in said connector housing;

an aperture formed in said rear wall of said connector housing;

an electrical extension cord having two electrical conductor wires and an electrical ground wire and each of said wires having front ends that extend in through said aperture formed in said rear wall of said connector housing and into said cavity in said connector housing;

a first pair of laterally spaced apertures formed in said front wall of said connector housing; a first pair of elongated electrical terminal members each having a front end and a rear end; said respective front ends of said electrical terminal members extending forwardly through said respective first pair of laterally spaced apertures; means connecting said rear ends of said respective electrical terminal members to said respective front ends of said two electrical conductor wires within said cavity in said connector housing; a ground pin having a front end, a rear end and a longitudinally extending K-axis; said front end of said ground pin extending forwardly from said front wall of said connector housing; means connecting said rear end of said ground pin to said front end of said ground wire within said connector housing; and means for rotating said ground pin about said K-axis once said ground pin has been inserted into the ground socket of a female electrical receptacle.

11. A lockable electrical cord connector unit as recited in claim 10 wherein said top surface of said connector housing has a wedge retainer cover aperture formed therein that communicates with said cavity in said connector housing; a wedge retainer cover is removably mounted in said wedge retainer cover aperture.

12. A lockable electrical cord connector unit as recited in claim 10 wherein said means for rotating said ground pin comprises a locking control ring having a front end, a rear end and an inner surface; said locking control ring being telescopically mounted over said connector housing so that it may be rotated with respect to said connector housing between a locked position and an unlocked position.

13. A lockable electrical cord connector unit as recited in claim 12 further comprising a front cover ring and a rear cover ring that are telescopically mounted over said connector housing respectively in front of and behind said locking control ring; and means for securing said front ring cover and said rear cover ring to said connector housing to prevent rotation with respect to said connector housing.

14. A lockable electrical cord connector unit as recited in claim 12 wherein said inner surface of said locking ring has a recessed eccentric control pin guide.

15. A lockable electrical cord connector unit as recited in claim 14 wherein said means for rotating said ground pin further comprises a cylindrical bore hole having a longitudinal K-axis extending inwardly from said front end of said connector housing and an eccentric ground pin cylinder having a front end, a rear end and an outer surface is rotatably mounted in said cylindrical bore hole.

16. A lockable electrical cord connector unit as recited in claim 15 wherein said rear end of said ground pin is mounted in said front end of said ground pin cylinder.

17. A lockable electrical cord connector unit as recited in claim 16 wherein said means for rotating said ground pin further comprises a radially oriented control pin having an inner end and an outer end; said inner end being captured in said outer surface of said ground pin cylinder and said outer end having means for fixedly connecting said outer end in an eccentric control pin guide in said inner surface of said locking ring; said outer surface of said connector housing having an arcuate control pin slot that communicates with said cylindrical bore hole and said eccentric control pin passes through said control pin slot during arcuate travel of said control pin.

18. The lockable electrical cord connector unit as recited in claim 1 further comprising a second pair of laterally spaced apertures formed in said rear wall of said connector housing; a second pair of elongated electrical terminal members each having a front end and a rear end; said respective front ends of said second pair of elongated electrical terminal members extending forwardly through said respective second pair of laterally spaced apertures; means connecting said rear ends of said respective second pair of electrical terminal members to said respective rear ends of said first pair of elongated electrical terminal members; a ground pin having a front end, a rear end and a longitudinally extending L-axis; said front end of said ground pin extending forwardly from said rear wall of said connector housing.

19. The lockable electrical cord connector unit as recited in claim 18 wherein said front wall of said connector housing has an electrical ground terminal socket formed therein.

20. The lockable electrical cord connector unit as recited in claim 19 further comprising means connecting said rear end of said ground pin to said electrical ground terminal socket formed in said front wall of said connector housing.

21. The lockable electrical cord connector unit as recited in claim 20 wherein said means for actuating movement of said wedge means between said first position and said second position also functions to rotate said ground pin extending from said rear wall about said L-axis once said ground pin has been inserted into the ground socket of a conventional female electrical receptacle.

22. The lockable electrical cord connector unit as recited in claim 21 wherein said means for actuating movement of said wedge means comprises a locking control ring having a front end, a rear end and an inner surface; said locking control ring being telescopically mounted over said connector housing so that it may be rotated with respect to said connector housing between a locked position and an unlocked position.

23. A lockable electrical cord connector unit as recited in claim 22 wherein said wedge means comprises a male wedge member aligned to reciprocally enter and withdraw from a female wedge member in response to rotation of said locking ring around said connector housing.

24. A lockable electrical cord connector unit as recited in claim 22 wherein said inner surface of said locking ring has a recessed eccentric control pin guide.

25. A lockable electrical cord connector unit as recited in claim 24 wherein said means for actuating movement of said wedge means further comprises a cylindrical bore hole having a longitudinal K-axis extending inwardly from said front wall of said connector housing; an eccentric cam ground cylinder having a front end, a rear end and an outer surface is rotatably mounted in said cylindrical bore hole.

26. A lockable electrical cord connector unit as recited in claim 25 wherein said means for actuating movement of said wedge means further comprises a radially oriented control pin having an inner end and an outer end; said inner end being captured in said outer surface of said cam ground cylinder and said outer end having means fixedly connecting said outer end in said eccentric control pin guide in said inner surface of said locking ring; said outer surface of said connector housing having an arcuate control pin slot that communicates with said cylindrical bore hole and said eccentric control pin passes through said control pin slot during arcuate travel of said control pin.

* * * * *